US006142532A

United States Patent [19]

Gluck

[11] Patent Number: 6,142,532

[45] **Date of Patent: *Nov. 7, 2000**

[54] MEMORABILIA CARD

[75] Inventor: Adrian Gluck, Newport Beach, Calif.

[73] Assignee: LNCJ Limited, St. Helier, United Kingdom

[ * ] Notice: This patent is subject to a terminal disclaimer.

[21] Appl. No.: 09/149,747

[22] Filed: Sep. 8, 1998

Related U.S. Application Data

[63] Continuation of application No. 08/356,481, Dec. 15, 1994, Pat. No. 5,803,501, and a continuation-in-part of application No. 08/192,438, Feb. 7, 1994, Pat. No. 5,421,583, which is a continuation-in-part of application No. 08/147,139, Nov. 3, 1993, Pat. No. 5,417,431.

[51] Int. Cl.[7] ..... B42D 15/00

[52] U.S. Cl. ..... 283/75; 283/117

[58] Field of Search ..... 283/74, 75, 67, 283/70, 56, 117; 40/124.1, 720, 768

[56] References Cited

U.S. PATENT DOCUMENTS

| | | |
|---|---|---|
| D. 326,067 | 5/1992 | Mayers . |
| 1,528,475 | 3/1925 | Gaunt . |
| 1,636,222 | 7/1927 | Fox . |
| 1,837,707 | 12/1931 | Follows . |
| 1,987,215 | 1/1935 | Romig . |
| 2,041,756 | 5/1936 | Gray . |
| 2,101,683 | 12/1937 | Leigh . |
| 2,586,039 | 2/1952 | Heggedal . |
| 2,731,749 | 1/1956 | Tarzian . |
| 2,914,873 | 12/1959 | Brennan . |
| 3,057,099 | 10/1962 | Fruchter . |
| 3,137,080 | 6/1964 | Zang . |
| 3,179,479 | 4/1965 | Freedman . |
| 3,261,126 | 7/1966 | Marks . |
| 3,715,816 | 2/1973 | White . |
| 3,868,283 | 2/1975 | Scheyer . |
| 3,879,874 | 4/1975 | Broussard . |
| 4,161,831 | 7/1979 | Restle . |
| 4,200,222 | 4/1980 | Feuer . |
| 4,336,664 | 6/1982 | Penick et al. . |
| 4,475,659 | 10/1984 | Well et al. . |
| 4,530,863 | 7/1985 | Seeger . |
| 4,601,490 | 7/1986 | Brandon . |
| 4,995,508 | 2/1991 | Burley . |
| 5,102,171 | 4/1992 | Saetre . |
| 5,103,579 | 4/1992 | Mayers . |
| 5,152,042 | 10/1992 | Mayers . |
| 5,174,204 | 12/1992 | Meier et al. . |
| 5,190,316 | 3/1993 | Hefty . |
| 5,238,345 | 8/1993 | D'Andrea . |
| 5,269,691 | 12/1993 | Waldman . |
| 5,282,649 | 2/1994 | Williams et al. . |

FOREIGN PATENT DOCUMENTS

| | | |
|---|---|---|
| 93 06 591 U | 4/1993 | Germany . |
| 2 265 856 | 10/1993 | United Kingdom . |

OTHER PUBLICATIONS

*Newport News,* Sep. 10, 1992, "It's Once, Twice, Three Times a Trading Card," pp. 5–6.

*Primary Examiner*—Willmon Fridie, Jr.
*Attorney, Agent, or Firm*—Lyon & Lyon LLP

[57] ABSTRACT

There is disclosed herein a memorabilia card in the form of a substrate having an image surface and wherein the image surface typically includes an action image of a famous figure. An example is a baseball batter in the act of batting a ball. There further is provided a miniature replica of an item used by the personality at a memorable event and which replica item is made from an item used by the personality at the memorable event. An example is a miniature bat adhered to the image surface in the position where an image of the bat normally would appear, and which is made from the bat used by the personality at a memorable event, such as a particular home run. The card further preferably includes the name of the personality and a certification of the authenticity of the item.

15 Claims, 1 Drawing Sheet

MEMORABILIA CARD

CROSS-REFERENCE TO RELATED APPLICATIONS

This application is a contination of Ser. No. 08/356,481 filed Dec. 15, 1994, now U.S. Pat. No. 5,803,501 and a continuation-in-part of application Ser. No. 08/192,438, filed Feb. 7, 1994, now U.S. Pat. No. 5,421,583, which is a continuation-in-part of application Ser. No. 08/147,139, filed Nov. 3, 1993, now U.S. Pat. No. 5,417,431 the disclosures of which are incorporated herein by reference.

The present invention relates to memorabilia, and more particularly to cards of the trading card type, such as baseball, football, basketball, hockey, soccer, country singers, comic characters and like trading cards and more particularly to a card which incorporates a portion of an implement involved in an historical event to provide a memorabilia card.

BACKGROUND OF THE INVENTION

Trading cards and similar vision effect articles are very familiar in the sports and entertainment fields, and they are a favorite of both youngsters and adults alike. Various forms of trading cards have been developed and promoted over the years, and each typically has on one side a reproduction of a photograph or likeness of a famous figure or personality. Information about the famous figure, such as statistical and biographical information, frequently is provided on the other side of the card. Premium type cards have been developed in recent years using high quality lithography. Some cards are printed on glossy cardboard stock with crisp color photographs of the player on the front and back. Although the cards usually are referred to as "trading" cards, they are today more frequently viewed as collectibles.

New forms of trading cards and other articles for providing enhanced visual effects are described in the above-identified applications.

In addition to trading cards, various devices or implements and pieces of clothing, such as baseballs, baseball bats, footballs, basketballs, jerseys, shoes, musical instruments, etc., are marketed in conjunction with photographs, plaques, and the like, as memorabilia. Examples are autographed baseballs, footballs, and the like, as well as photographs and trading cards with an actual autograph and with some form of authentication in the form of a serial number, hologram, or the like. In some cases the item (e.g., baseball, bat, football, etc.) is the one used for some particular memorable event (e.g., 40th home run, 100th touchdown pass, 1000th concert, etc.), and are retained by the famous figure involved or, alternatively, sold at a relatively high price by that person or someone else. Unfortunately, the high price of such items places them outside of the ability of youngsters and average income families to purchase or otherwise obtain them.

SUMMARY OF THE INVENTION

The concept of the present invention is to provide an actual piece or portion of an item in combination with a photograph or the like of a famous figure having a relationship to the item. The item can be combined with a photograph, an image on a trading card, or with famous figure images such as those described in the above-identified co-pending applications, or the like.

In a particular exemplary embodiment of the concepts of the present invention, a memorabilia card is provided comprising a photograph or other printed image of a sports player such as a baseball player shown in an action image holding or swinging a bat, and wherein the bat of the memorabilia card comprises a miniature bat of an appropriate proportion to the person's image, and wherein the miniature bat has been formed using some material from the actual bat used by that person during a memorable event, such as for example, when he hit his 40th home run in a particular year. The photograph can be a photograph of the actual event memorialized, such as the 40th home run.

This is accomplished by retaining and purchasing the actual bat, then manufacturing a large number of tiny bats using material from the actual bat, and then gluing or otherwise adhering the tiny or miniature bat onto the picture over or in place of the bat in the action photograph. Additionally, the picture or its associated trading card, plaque or the like, can include an appropriate certification that the miniature bat contains material from the genuine bat used by that player during the memorable event (e.g., 40th home run).

The concepts of this invention are not limited to a sports item like a bat, but can include a miniature piece of any other item, such as a baseball, base, clothing (e.g., hat, shirt, shoes, etc.) and accessories such as sunglasses and bracelets, and furthermore the concepts are applicable to any form of sport (including football, hockey, basketball, soccer, etc., and any of the items used in or by players in those sports (e.g., piece of a football, hockey stick, soccer ball, basketball, clothing, etc.)) or entertaiment.

Accordingly, it is a principle object of the present invention to provide a new form of memorabilia item.

Another object of the present invention is to provide a memorabilia card memorializing a sporting or entertaiment event and related item.

A further object of this invention is to provide a photograph or other image likeness of a famous figure, along with a miniature or tiny piece of an actual sports item or implement used by the famous figure during a particular event to be memorialized.

BRIEF DESCRIPTION OF THE DRAWING

These and other objects and features of the present invention will become better understood through a consideration of the following description taken in conjunction with the drawing in which.

DETAILED DESCRIPTION

Figure 1:
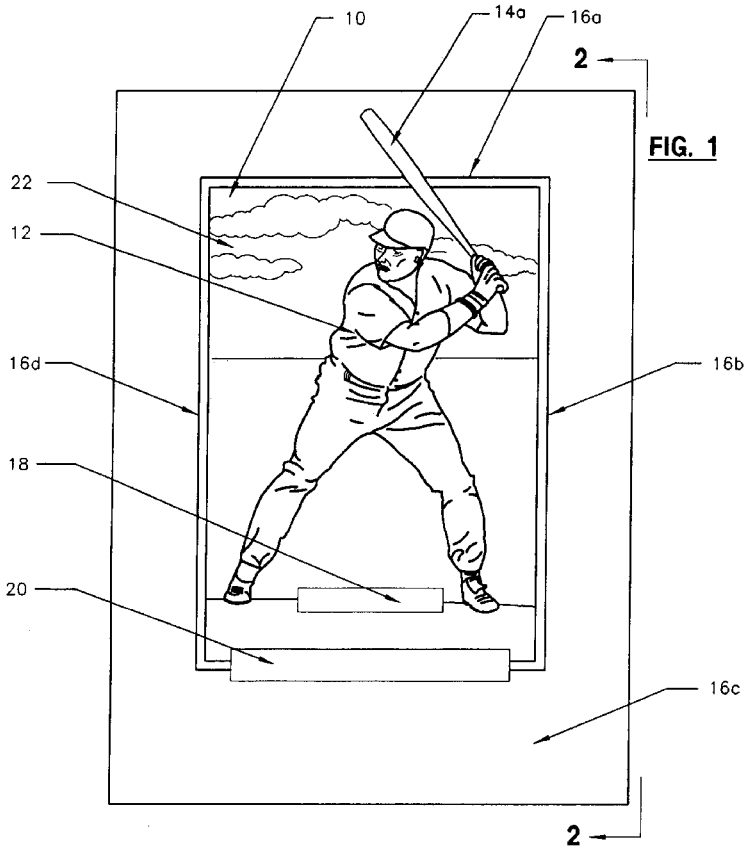
FIG. 1 is an elevational view of a memorabilia card according to the present invention.
Figure 2:
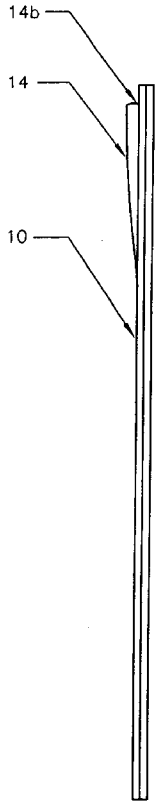
FIG. 2 is a cross-section view thereof taken along a line 2—2 of FIG. 1.
Figure 3:
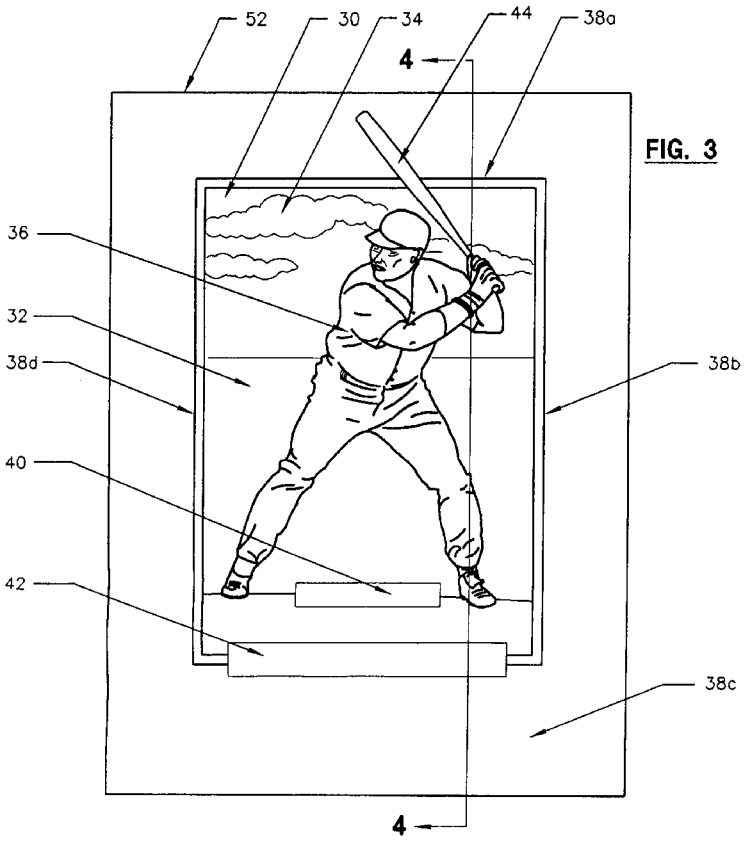
FIG. 3 is an elevational view similar to FIG. 1, but of a trading card with a three-dimensional effect of the nature shown and described in the above-identified co-pending applications.
Figure 4:
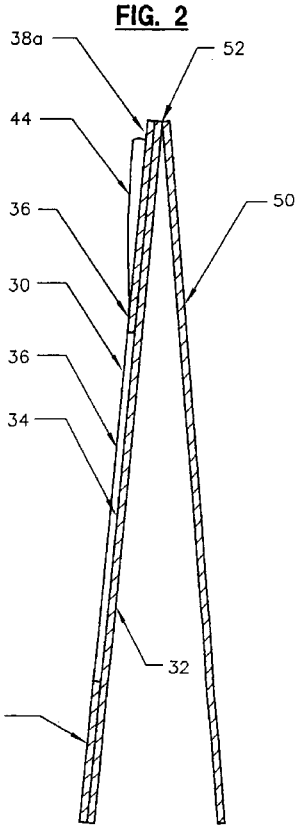
FIG. 4 is a cross-sectional view of the card of FIG. 3 taken along a line 4—4 thereof.

Turning now to the drawing, FIGS. 1 and 2 show a first embodiment according to the present invention, and FIGS. 3 and 4 illustrate a second embodiment. In the embodiment of FIG. 1, the same comprises essentially a photograph or an image formed by lithography or other photographic or printing method, and comprises a plainer sheet of material 10 as seen in FIGS. 1 and 2 with a rendering 12 of an exemplary baseball player holding a bat 14. The image may further comprise a background image 22, as well as a border area 16*a–d,* along with a block or area 18 for the player's name and/or other information such as the particular event (e.g., 40th home run), and a block or area 20 which can comprise a printed certification as will be explained in further detail. According to the present invention, the bat 14 comprises an actual miniature bat formed from material from an actual real bat used by this particular player in the event being commemorated (e.g., 40th home run). The bat 14 may be in a tapered cylindrical form with the same proportions of a real bat or, alternatively, the face 14*a* may have that shape, whereas the rear side which is adjacent the image surface 10 may be flattened as at 14*b*. The bat 14 is secured to the card 10 preferably over the image of the bat held by the player 12.

Thus, in the embodiment of FIGS. 1 and 2, the image is essentially identical to any photograph, lithograph or other printed sheet or card, and much like conventional trading cards, except that it includes suitably adhered thereto a miniature bat 14, along with a certification 20 certifying the authenticity of that bat 14, being a portion of the actual bat used by that player at the event being memorialized. It may include a background 22.

Another embodiment is illustrated in FIGS. 3 and 4 wherein the basic card 30 is made according to the concepts described in the above-noted co-pending patent applications, the disclosures of which are incorporated herein by reference. The card 30 comprises a base substrate 32 having a background image 34 and a foreground image of a player 36. The surface of the foreground picture of the player 36 is slightly spaced outwardly from the background picture area 34, and as described in said co-pending applications typically is about forty-thousandths of an inch and within the range of approximately ten to sixty-thousandths of an inch. Similarly, a frame comprising the sections 38*a–d* preferably also is raised or extends outwardly to help provide an enhanced realism picture, although it is not required that this frame 38 so extend outwardly. Further, the embodiment of FIGS. 3 and 4 can include a block or area 40 for the player's name, and a block or area 42 for a certificate like area 20 in FIG. 1.

Importantly, the embodiment of FIGS. 3 and 4 also includes a bat 44 like the bat 14 of FIGS. 1 and 2. That is, the bat 44 is a miniature bat formed from the actual bat used by the player at the memorable event, and the certificate 42 attests to that authenticity. As was the case with FIGS. 1 and 2, the bat 44 can be in a cylindrical tapered form with proportions like a real bat, or the bottom side which adjoins the image area 34 can be flattened. In either case, the bat 44 is secured by a suitable adhesive to the substrate 30. The bat 44, as does the bat 14, provides a further enhanced realism as well as enhances the memorabilia value of the overall card.

In the embodiment of FIGS. 3 and 4, the substrate 30 can be extended to include a section 50 which, as best seen in FIG. 4, forms an "A" frame or stand in combination with the substrate 30. Preferably, there is a small die cut along top edge 52 which allows the substrate sections 30 and 50 to readily fold flat or be extended outwardly in the "A" fashion as seen in FIG. 4.

Although exemplary embodiments of the present invention have been shown and described in connection with a baseball player and a baseball bat, the concepts are applicable to all sports and other activities and items which may function as memorabilia as earlier noted. For example, the present concepts could be extended to use for personal and other photographs, wherein some items, such as a piece of wedding gown of a bride, is secured to a photograph of the person over or adjacent to the image of the item.

While embodiments of the present invention have been shown and described, various modifications may be made without departing from the scope of the present invention, and all such modifications and equivalents are intended to be covered.

What is claimed is:

1. An article of memorabilia comprising, a first member, and a portion, but not the entirety, of an authentic memorabilia item used by a popular sport or entertainment personality or during a memorable event, said portion attached to said first member.

2. An article as in claim 1 wherein the first member is a card having a face surface, and said portion is attached to said face surface.

3. An article as in claim 1 wherein the authentic item is a baseball bat, and said portion comprises a tiny piece of wood taken from that bat.

4. An article as in claim 1 wherein the first member includes a sports trading card having an image surface, and said portion is affixed to said surface near where an image of the authentic item normally would appear.

5. An article as in claim 1 wherein the first member comprises a scaled version of the sports or entertainment personality.

6. An article as in claim 1 wherein said portion comprises a tiny piece of an authentic item of clothing worn by the sports or entertainment personality.

7. An article as in claim 1 wherein the authentic item is a baseball, and said portion comprises a tiny piece of material taken from said baseball.

8. An article as in claim 1 wherein the authentic item is a football, and said portion comprises a tiny piece of material taken from said football.

9. An article as in claim 1 wherein the authentic item is a basketball, and said portion comprises a tiny piece of material taken from said basketball.

10. An article as in claim 1 wherein the authentic item is a hockey puck, and said portion comprises a tiny piece of material taken from said hockey puck.

11. An article as in claim 1 wherein the authentic item is a soccer ball, and said portion comprises a tiny piece of material taken from said soccer ball.

12. An article of memorabilia comprising, a first member, and a portion, but not the entirety, of an authentic memorabilia item used in a popular sport or form of entertainment or during a memorable event, said portion incorporated into said first member.

13. A memorabilia article comprising at least a piece of an authentic implement used or worn either by a popular sport or entertainment person or during a memorable event and wherein less than all of the implement is included.

14. An article as in claim 13 wherein the implement is a baseball bat, and the piece comprises a tiny piece of wood from that bat, thereby enabling a large number of such articles to be manufactured from the bat.

15. An article as in claim 13 further including a card having an image surface, and the article being adhered to said surface near where an image of the implement normally would appear.

* * * * *

US006142532C1

(12) EX PARTE REEXAMINATION CERTIFICATE (6021st)

United States Patent
Gluck

(10) Number: US 6,142,532 C1
(45) **Certificate Issued: *Nov. 27, 2007**

(54) MEMORABILIA CARD

(75) Inventor: Adrian Gluck, Newport Beach, CA (US)

(73) Assignee: Media Technologies Licensing, LLC, Beverly Hills, CA (US)

Reexamination Request:
No. 90/007,245, Oct. 4, 2004
No. 90/008,075, Jun. 29, 2006

Reexamination Certificate for:

| | |
|---|---|
| Patent No.: | **6,142,532** |
| Issued: | **Nov. 7, 2000** |
| Appl. No.: | **09/149,747** |
| Filed: | **Sep. 8, 1998** |

( * ) Notice: This patent is subject to a terminal disclaimer.

Related U.S. Application Data

(63) Continuation of application No. 08/356,481, filed on Dec. 15, 1994, now Pat. No. 5,803,501, and a continuation-in-part of application No. 08/192,438, filed on Feb. 7, 1994, now Pat. No. 5,421,583, which is a continuation-in-part of application No. 08/147,139, filed on Nov. 3, 1993, now Pat. No. 5,417,431.

(51) Int. Cl.
*B42D 15/00* (2006.01)

(52) U.S. Cl. ..... 283/75; 283/117
(58) Field of Classification Search ..... None
See application file for complete search history.

(56) References Cited

U.S. PATENT DOCUMENTS 5,803,501 A * 9/1998 Gluck ..... 283/75

OTHER PUBLICATIONS

Answer, affirmative defenses and counter claim of defendant of The Topps Company, Inc, dated Apr. 21, 2000.
Plaintiff and counter claim defendant's answer to counter claim of The Topps Company, Inc, dated May 15, 2000.
Amended Answer, affirmative defenses and counter claim of defendant The Topps Company, Inc, dated Sep. 22, 2000.
Plaintiff and counter claim defendant's answer to first amended counterclaim to of The Topps Company, Inc, dated Oct. 16, 2000.
Answer, counter claim and demand for jury trial; certification as to interested parties re fleer/skybox international, LP, dated Apr. 28, 2000.
Plaintiff and counter claim defendant's answer to counter claim of fleer/skybox International, LP dated May 17, 2000.
First amended answer, counter claim and demand for jury trial, dated Sep. 20, 2000.
Plaintiff and counter claim defendant's answer to first amended counter claim of fleer/skybox international, LP, dated Oct. 16, 2000.

(Continued)

*Primary Examiner*—Michael O'Neill

(57) ABSTRACT

There is disclosed herein a memorabilia card in the form of a substrate having an image surface and wherein the image surface typically includes an action image of a famous figure. An example is a baseball batter in the act of batting a ball. There further is provided a miniature replica of an item used by the personality at a memorable event and which replica item is made from an item used by the personality at the memorable event. An example is a miniature bat adhered to the image surface in the position where an image of the bat normally would appear, and which is made from the bat used by the personality at a memorable event, such as a particular home run. The card further preferably includes the name of the personality and a certification of the authenticity of the item.

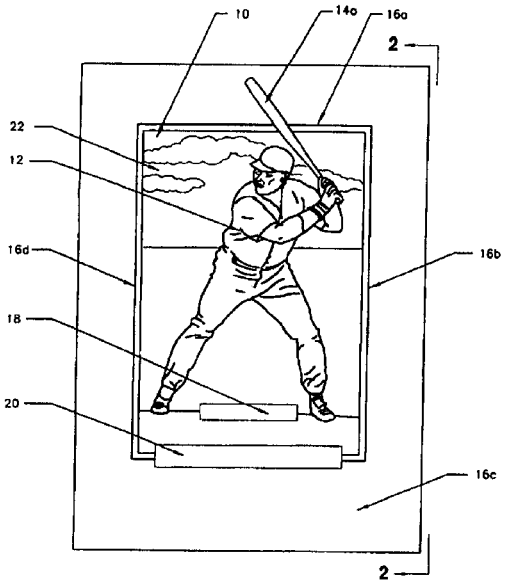

OTHER PUBLICATIONS

Defendant's answer to plaintiff Telepresence Technologies, Inc.'s corrected complaint for patent infringement; and counter claim for declaratory judgment of non–infringement, invalidity, unenforceability and ownership of U.S. Patents 5,417,431; 5,421,583; and 5,803,501; breach of fiduciary duty; breach of confidence; Violation of California business and professions code sections 17200 et seq.; and breach of contract; demand for jury trial, dated Apr. 28, 2000.

Plaintiff and counter claim defendants' answer to counter claim, dated May 17, 2000.

Answer and counter claim, dated Apr. 28, 2000.

Plaintiff and counter claim defendant's answer to counter claim of Racing Champions South, Inc., dated May 17, 2000.

Answer and counter claim to first amended complaint; demand for jury trial, dated May 1, 2000.

Plaintiff and counter claim defendant's answer to counter claim of Collector's Edge of Tennessee, Inc., dated May 23, 2000.

First amended answer and counter claim; demand for jury trial, dated Sep. 22, 2000.

Plaintiff and counter claim defendant's answer to first amended counter claim of Collector's Edge of Tennessee, Inc., dated Oct. 16, 2000.

Answer and counter claim; demand jury trial; defendant's notice of certification as to interested parties, dated May 1, 2000.

Plaintiff and counter claim defendant's answer to counter claim of Playoff Corporation, dated May 23, 2000.

First amended answer and counter claim; demand for jury trial, dated Sep. 22, 2000.

Plaintiff and counter claim defendant's answer to first amended counter claim of Playoff Corporation, dated Oct. 16, 2000.

Answer and counter claim for declaratory relief; demand for jury trial, dated May 1, 2000.

Plaintiff and counter claim defendant's answer to counter claim of L.I. Laser Innovations, Inc., dated May 23, 2000.

Answer of In The Game, Inc. and counter claims for (1) declaratory judgment of non–infringement and invalidity, dated May 5, 2000.

Plaintiff and counter claim defendant's answer to counter claim on In The Game, Inc., dated May 26, 2000.

Amended answer of In The Game, Inc. and counter claims for (1) declaratory judgment of non–infringement and invalidity, dated Sep. 22, 2000.

Plaintiff and counter claim defendant's answer to first amended counter claim of In The Game, Inc., dated Oct. 16, 2000.

Defendant Pacific Trading Cards, Inc's answer and affirmative defenses to plaintiff's complaint for patent infringement of U.S. Patent No. 5,803,501 and counter claim for declaratory judgment of non–infringement, and invalidity of U.S. Patent. No. 5,803,501, dated May 9, 2000.

Plaintiff and counter claim defendant's answer to the counter claim of Pacific Trading Cards, Inc., dated May 26, 2000.

Defendant's the Upper Deck Company's and the Upper Deck Company, LLC's answer to plaintiff Media Technologies, licensing LLC's corrected first amended complaint for patent infringement; and counter claim and cross–complaint for declaratory judgment of non–infringement, invalidity, unenforceability and ownership of U.S. Patent 5,803,501; breach of fiduciary duty; breach of confidence; violation of California business and professions code sections 17200 et seq.; breach of contract ; unjust enrichment; and conversion; demand for jury trial, dated Jan. 30, 2002.

Defendant's The Upper Deck Company's and The Upper Deck Company, LLC's answer to plaintiff Media Technologies, licensing, LLC's corrected first amended complaint for patent infringement; and first amended counter claim and cross–complaint for declaratory judgment of non–infringement, invalidity, unenforceability and ownership of U.S. Patent No. 5,803,504; breach of fiduciary duty; breach of confidence; violation of California business and professions code sections 17200 et seq. ; breach of contract; demand for a jury trial, dated Mar. 18, 2002.

Plaintiff and counter defendant Media Technologies, licensing, LLC's answer to first amended counter claim and cross–complaint of The Upper Deck Company, The Upper Deck Company, LLC, and Upper Deck Distribution and Sales Company; demand for a jury trial, dated Apr. 12, 2002.

Cross–Defendant Adrian Gluck's answer to first amended counter claim and cross–complaint of The Upper Deck Company, The Upper Deck Company, LLC, and Upper Deck Distribution and Sales Company, dated Apr. 12, 2002.

The Topp's Company's answer and counter claim; demand for jury trial, dated Feb. 4, 2002.

The Topps's Company's answer and counter claim; demand for jury trial, dated Jan. 30, 2002.

Plaintiff and counter defendant Media Technologies, Licensing, LLC's answer to counter claim of The Topp's Company, Inc., demand for jury trial, dated Feb. 19, 2002.

Defendant's Racing Champions Corporation's and Racing Champions South, Inc.'s, answer to complaint; demand for jury trial, dated Jan. 28, 2002.

Defendants Racing Champions Corporation's and Racing Champions South, Inc.'s, answer to first amended complaint, dated Jan. 31, 2002.

Plaintiff and counter defendant Media Technologies, Licensing, LLC's answer to counter claim of Racing Champions South, Inc; Demand for jury trial, dated Feb. 19, 2002.

Defendant Playoff Corporation's answer and counter claim; demand for jury trial, dated Jan. 30, 2002.

Plaintiff and counter defendant Media Technologies, Licensing, LLC's, answer to counter claim of Playoff Corporation; demand for jury trial, dated Feb. 19, 2002.

Pacific Trading Cards, Inc.'s answer , affirmative defenses, counter claim and demand for jury trial, dated Jan. 30, 2002.

Plaintiff and Counter defendant Media Technologies, Licensing, LLC's answer to counter claim of Pacific Trading Cards, Inc.; Demand for jury trial, dated Feb. 19, 2002.

Defendant In The Game, Inc.'s answer and counter claim; demand for jury trial, dated Jan. 30, 2002.

Plaintiff and counter defendant Media Technologies, Licensing, LLC's answer to counter claim of In The Game; Inc.; demand for jury trial, dated Feb. 19, 2002.

Fleer/Skybox International LP's answer to first amended complaint and counter claim, dated Jan. 30, 2002.

Plaintiff and counter defendant Media Technologies, Licensing, LLC's answer to counter claim of Fleer/Skybox International LP; demand for jury trial, dated Feb. 19, 2002.
Defendant Fleer/Skybox International LP's notice of reinstatement of counter claim; demand for jury trial, dated Oct. 3, 2003.
Defendant Collector's Edge of Tennessee, Inc.'s answer and counter claim demand for jury trial, dated Jan. 30, 2002.
Plaintiff and counter defendant Media Technologies, Licensing, LLC's answer to counter claim of Collector's Edge of Tennessee, Inc.; demand for jury trial, dated Feb. 19, 2002.
Collector's Edge of Tennessee, Inc., Playoff Corporation, In The Game, Inc., and Pacific Trading Cards, Inc's notice of reinstatement of counter claims, dated Oct. 9, 2003.
Stipulation to dismiss all counter claims and cross–complaints ; order thereon, dated Jul. 12, 2002.
Defendants The Upper Deck Company's and The Upper Deck Company, LLC's answer to plaintiff Media Technologies, [sic] Licensing, LLC's second amended complaint for patent infringement ; and second amended counter claim and cross–complaint for declaratory judgment of non–infringement, invalidity, unenforceability and ownership of U.S. Patents 5,803,501 and 6,142,532; breach of fiduciary duty; breach of confidence; violation of California business and professions code sections 17200 et seq.; breach of contract; unjust enrichment; and conversion; demand for jury trial, dated Nov. 24, 2003.
Plaintiff and Counterdefendant Media Technologies Licensing, LLC's Answer to second amended counterclaim and cross–complaint of The Upper Deck Company, The Upper Deck Company, LLC and Upper Deck Distribution and Sales Company. Cross–defendant Adrian Gluck's answer to second amended counterclaim and cross–complaint of The Upper Deck Company, The Upper Deck Company, LLC, and Upper Deck Distribution and Sales Company. Demand for jury trial, dated Dec. 17, 2003.
ITG's first amended answer and counter claim ; demand for jury trial; dated Dec. 1, 2003.
Plaintiff and counter defendant Media Technologies Licensing, LLC's answer to counter claim of In The Game, Inc.; demand for jury trial; dated Dec. 17, 2003.
Defendant The Topp's Company, Inc.'s answer and counter claim to plaintiff Media Technologies, Licensing, LLC's second amended complaint, dated Nov. 26, 2003.
Plaintiff and counterdefendant Media Technologies Licensing, LLC's answer to counterclaim of The Topps Company, Inc. Demand for jury trial, dated Dec. 17, 2003.
Rittenhouse;s first amended answer and counter claim; demand for jury trial, dated Dec. 1, 2003.
Plaintiff and counter defendant Media Technologies, Licensing, LLC's answer to counter claim of Rittenhouse Archives, Ltd.; demand for jury trial , dated Dec. 17, 2003.
Playoff's first amended answer and counter claim; demand for jury trial; dated Dec. 1, 2003.
Plaintiff and counter defendant Media Technologies, Licensing, LLC's answer to counter claim of Playoff Corporation; demand for jury trial; dated Dec. 17, 2003.
Pacific's first amended answer and counter claim; demand for jury trial; dated Dec. 1, 2003.
Plaintiff and counter defendant Media Technologies, Licensing, LLC's answer to counter claim of Pacific Trading Cards, Inc.; demand for jury trial; dated Dec. 17, 2003.
Inkwork's first amended answer and counter claim; demand for jury trial; dated Dec. 1, 2003.
Plaintiff and counter defendant Media Technologies, Licensing, LLC; answer to counter claim of Inkworks, Inc.; demand for jury trial; dated Dec. 17, 2003.
CET's first amended answer and counter claim; demand for jury trial; dated Dec. 1, 2003.
Plaintiff and counter defendant Media Technologies, Licensing, LLC's answer to counter claim of Collector's Edge of Tennessee, Inc.; demand for jury trial; dated Dec. 17, 2003.
Defendant and counter claimant Fleer/Skybox International LP's answer and counter claim to plaintiff Media Technologies, Licensing, LLC's second amended complaint for patent infringement (U.S. Patent No. 5,803,501 & 6,142,532), dated Nov. 26, 2003.
Plaintiff and counter defendant Media Technologies, Licensing, LLC's answer to counter claim of Fleer/Skybox International, LP; demand for jury trial; dated Dec. 17, 2003.
Answer and counter claim of defendants Racing Champions Corporation and Racing Champions South, Inc. to second amended complaint; demand for jury trial, dated Dec. 3, 2003.
Plaintiff and counter defendant Media Technologies, Licensing, LLC's answer to counter claim of Racing Champions South, Inc.; Demand for jury trial; dated Dec. 17, 2003.
Plaintiff Media Technologies, Licensing, LLC's request for admission to Collector's Edge of Tennessee, Inc., set four (Nos. 6–11); dated Jun. 28, 2004.
CET's objections and responses to Media Technologies' fourth set of requests for admissions (Nos. 6–11); dated Sep. 24, 2004.
Plaintiff Media Technologies, Licensing, LLC's request for admission to In The Game, Inc., set four (Nos. 6–11); dated Jun. 28, 2004.
ITG's objections and responses to Media Technologies' fourth set of requests for admissions (Nos. 6–11) ;dated Sep. 24, 2004.
Plaintiff Media Technologies, Licensing, LLC's request for admission to Inkworks, Inc., set four (Nos. 6–11); dated Jun. 28, 2004.
Inkworks' objections and responses to Media Technologies' fourth set of requests for admissions (Nos. 6–11) ; dated Sep. 24, 2004.
Plaintiff Media Technologies, Licensing, LLC's request for admission to Pacific Trading cards, Inc., set four (Nos. 6–11); dated Jun. 28, 2004.
Pacific's responses to Media Technologies' request for admission to Pacific Trading Cards, Inc., set four (Nos. 6–11), dated Sep. 16, 2004.
Plaintiff Media Technologies, Licensing, LLC's request for admission to Playoff Corporation, set three (Nos. 6–11); dated Jun. 28, 2004.
Playoff's objections and responses to Media Technologies' fourth set of requests for admissions (Nos. 6–11), dated Sep. 24, 2004.
Plaintiff Media Technologies, Licensing, LLC's request for admission to Racing Champions Corporation and Racing Champions South, Inc., set three (Nos. 6–11) ;dated Jun. 28, 2004.
Plaintiff Media Technologies, Licensing, LLC's request for admission to The Topps Company, Inc., set four (Nos. 44–49); Jun. 28, 2004.
Response to defendant The Topps Company, Inc.'s responses to Plaintiff's request for admission to The Topps Company, Inc., (Nos. 41–49), dated Sep. 27, 2004.

Plaintiff Media Technologies, Licensing, LLC's request for admission to The Upper Deck Company and The Upper Deck Company, LLC, set four (Nos. 44–49), dated Jun. 28, 2004.
Defendant The Upper Deck Company's and The Upper Deck Company LLC's responses and objections to Media Technologies fourth request for admissions, dated Sep. 23, 2004.
Plaintiff Media Technologies' first set of interrogatories to Collector's Edge of Tennessee, Inc. (Nos. 1–10); dated Sep. 29, 2003.
Collector's Edge of Tennessee's objections and responses to plaintiff's first set of interrogatories (1–10), dated Nov. 10, 2003.
Collector's Edge of Tennessee's amended and supplemental objections and responses to Media Technologies' first set of interrogatories (Nos. 1–10); dated Nov. 15, 2004.
Plaintiff Media Technologies first set of interrogatories to Playoff Corporation, (Nos. 1–10); dated Sep. 29, 2003.
Playoff's objections and responses to plaintiff's first set of interrogatories (1–10), dated Nov. 10, 2003.
Playoffs' amended and supplemental objections and responses to Media Technologies' first set of interrogatories (Nos. 1–10), dated Nov. 15, 2004.
Plaintiff Media Technologies' first set of Interrogatories to In The Game, Inc. (Nos. 1–10); dated Sep. 29, 2003.
In The Game's objections and responses to plaintiff's first set of Interrogatories (1–10), dated Nov. 10, 2003.
In the Games' amended and supplemental objections and responses to Media Technologies' first set of interrogatories (Nos. 1–10); dated Nov. 15, 2004.
Plaintiff Media Technologies' first set of Interrogatories to Inkworks, Inc., (Nos. 1–15); dated Sep. 29, 2003.
Inkwork's objections and responses to plaintiff's first set of interrogatories (1–15), dated Nov. 10, 2003.
Inkworks' amended and supplemental objections and responses to Media Technologies' first set of Interrogatories (Nos. 1–15); );); dated Nov. 15, 2004.
Plaintiff Media Technologies' first set of Interrogatories to Fleer/Skybox International, LP (Nos. 1–12); dated Sep. 29, 2003.
Defendant and counterclaimant Fleer/Skybox International's objections and responses to plaintiff's first set of interrogatories, dated Nov. 6, 2003.
Defendant and counter claimant Fleer/Skybox International LP's supplemental objections and responses to plaintiff Media Technologies Licensing, LLC's first set of interrogatories, dated Mar. 8, 2004.
Plaintiff Media Technologies' first set of interrogatories to Pacific Trading Cards, Inc. (Nos. 1–10); dated Sep. 29, 2003.
Pacific's objections and responses to plaintiff's first set of interrogatories (1–10), dated Nov. 10, 2003.
Plaintiff Media Technologies' first set of interrogatories to Racing Champions Corporation (Nos. 1–11); dated Sep. 29, 2003.
Racing Champions Corporations and Racing Champions South responses to plaintiffs first set of interrogatories (Nos. 1–11), dated Nov. 10, 2003.
Plaintiff Media Technologies' first set of interrogatories to Rittenhouse Archives, Ltd. (Nos. 1–15); dated Sep. 29, 2003.
Rittenhouse's objections and responses to plaintiff's first set of interrogatories (1–15), dated Nov. 10, 2003.
Plaintiff Media Technologies' first set of interrogatories to The Topps Company, Inc. (Nos. 1–9); dated Sep. 29, 2003.
Defendant Topps Company, Inc.'s response to plaintiff's first set of interrogatories (Nos. 1–9), dated Nov. 6, 2003.
Plaintiff Media Technologies' first set of Interrogatories to The Upper Deck Company (Nos. 1–10), dated Sep. 29, 2003.
Defendant Upper Deck Company's responses and objections to plaintiff's first set of interrogatories, dated Nov. 6, 2003.
Defendant The Upper Deck Company's first supplemental responses and objections to plaintiff Media Technologies first set of interrogatories, dated Feb. 9, 2004.
Plaintiff Media Technologies' third set of Interrogatories to Collector's Edge of Tennessee, Inc. (No. 11); dated Dec. 22, 2003.
CET's objections and responses to Media Tech's third set of interrogatories (No. 11); dated Jan. 26, 2004.
CET's amended objections and responses to Media Tech's third set of interrogatories (No. 11); dated Nov. 15, 2004.
Plaintiff Media Technologies' third set of interrogatories to In The Game Inc. (No. 11); dated Dec. 22, 2003.
ITG's objections and responses to Media Tech's third set of interrogatories (No. 11); dated Jan. 26, 2004.
ITG's amended objections and responses to Media Tech's third set of interrogatories (No. 11); dated Nov. 15, 2004.
Plaintiff Media Technologies' third set of interrogatories to Inkworks, Inc.. (No. 16); dated Dec. 22, 2003.
Inkworks' objections and responses to Media Tech's third set of interrogatories (No. 16); dated Jan. 26, 2004.
Inkwork's amended objections and responses to Media Tech's third set of interrogatories (No. 16); dated Nov. 15, 2004.
Plaintiff Media Technologies' third set of interrogatories to Fleer/Skybox International LP (Nos. 13–14); dated Dec. 22, 2003.
Defendant and counter claimant Fleer/Skybox International, LP's objections and responses to plaintiff Media Technologies Licensing, LLC's third set of interrogatories to Fleer/Skybox International LP (Nos. 13 and 14).
Plaintiff Media Technologies' third set of interrogatories to Pacific Trading Cards, Inc. (No. 11); dated Dec. 22, 2003.
Pacific's objections and responses to Media Tech's third set of interrogatories (No. 11); dated Jan. 26, 2004.
Plaintiff Media Technologies' third set of interrogatories to Playoff Corporation (No. 11); dated Dec. 22, 2003.
Playoff's objections and responses to Media Tech's third set of interrogatories (No. 11); dated Jan. 26, 2004.
Playoff's amended objections and responses to Media Tech's third set of interrogatories (No. 11), dated Nov. 15, 2004.
Plaintiff Media Technologies' third set of interrogatories to Racing Champions Corporations and Racing Champions South, Inc. (No. 12); dated Dec. 22, 2003.
Plaintiff Media Technologies' third set of interrogatories to Rittenhouse Archives Ltd. (No. 16); dated Dec. 22, 2003.
Rittenhouse's objections and responses to Media Tech's third set of interrogatories (No. 16), dated Jan. 26, 2004.
Plaintiff Media Technologies' third set of interrogatories to The Topps Company, Inc. (No. 10); dated Dec. 22, 2003.
Defendant and counter claimant The Topps Company, Inc.'s response to plaintiff's third set of interrogatories (No. 10); dated Jan. 26, 2004.

Plaintiff Media Technologies' third set of interrogatories to The Upper Deck Company and The Upper Deck Company, LLC (No. 12); dated Dec. 22, 2003.

Defendant The Upper Deck Company's and The Upper Deck Company LLC's responses and objections to plaintiff Media Technologies third set of interrogatories (No. 12), dated Jan. 26, 2004.

Defendant The Upper Deck Company's and The Upper Deck Company LLC's first supplemental responses and objections to plaintiff Media Technologies third set of interrogatories (No. 12), dated Feb. 9, 2004.

Exhibit A to plaintiff Media Technologies Licensing, LLC's third set of interrogatories, dated Dec. 22, 2003.

Plaintiff Media Technologies' fourth set of interrogatories to Collector's Edge of Tennessee, Inc. (No. 12); dated Jun. 24, 2004.

CET's objections and responses to Media Technologies' fourth, fifth and sixth sets of interrogatories (Nos. 12–15); dated Sep. 21, 2004.

CET's amended and supplemental objections and responses to Media Technologies' fourth, fifth, and sixth sets of interrogatories (Nos. 12–15).

Plaintiff Media Technologies' fourth set of interrogatories to In The Game, Inc. (No. 12); dated Jun. 24, 2004.

ITG's objections and responses to Media Technologies' fourth, fifth and sixth sets of interrogatories (Nos. 12–15); dated Sep. 21, 2004.

Plaintiff Media Technologies' fourth set of interrogatories to Inkworks' (No. 17); dated Jun. 24, 2004.

Inkworks' objections and responses to Media Technologies' fourth, fifth and sixth sets of interrogatories (Nos. 12–15); dated Sep. 21, 2004.

Inkwork's amended objections and responses to Media Technologies' fourth, fifth, and sixth sets of interrogatories (Nos. 17–20), dated Sep. 22, 2004.

Plaintiff Media Technologies' fourth set of interrogatories to Pacific Trading Cards, Inc. (No. 12); dated Jun. 24, 2004.

Pacific's objections and responses to Media Technologies' fourth set of interrogatories (No. 12), dated Sep. 16, 2004.

Plaintiff Media Technologies' fourth set of interrogatories to Playoff Corporation (No. 12); dated Jun. 24, 2004.

Playoff's objections and responses to Media Technologies' fourth, fifth and sixth sets of interrogatories (Nos. 12–15), dated Sep. 21, 2004.

Playoff's amended and supplemental objections and responses to Media Technologies' fourth, fifth, and sixth sets of interrogatories (Nos. 12–15), dated Nov. 15, 2004.

Plaintiff Media Technologies' fourth set of interrogatories to Racing Champions Corporation and Racing Champions South, Inc.. (No. 13); dated Jun. 24, 2004.

Plaintiff Media Technologies' fourth set of Interrogatories to The Topps Company, Inc. (No. 11); dated Jun. 24, 2004.

Defendant The Topps Company, Inc's responses to plaintiff's interrogatories numbered 11–22 (sets 4,5,6,7,8 and 9), dated Sep. 27, 2004.

Plaintiff Media Technologies' fourth set of interrogatories to The Upper Deck Company and The Upper Deck Company, LLC (No. 13), dated Jun. 24, 2004.

Defendant The Upper Deck Company's and The Upper Deck Company LLC's responses and objections to plaintiff Media Technologies, fourth, fifth and sixth sets of interrogatories (Nos. 13–16), dated Sep. 20, 2004.

Cross defendant Adrian Gluck's first set of interrogatories to The Upper Deck Company and The Upper Deck Company, LLC (Nos. 1–4), dated Jun. 28, 2004.

Defendant The Upper Deck Company's and The Upper Deck Company, LLC's amended responses and objections to 1. Plaintiff Media Technologies seventh set of interrogatories (Nos. 17–21) and 2. Cross Defendant Adrian Gluck's first set of interrogatories to The Upper Deck Company and The Upper Deck Company LLC (1–4), dated Nov. 5, 2004.

Defendant The Upper Deck Company's and The Upper Deck Company LLC's supplemental and amended responses and objections to plaintiff Media Technologies interrogatories Nos. 2,3,5–8,11,14,15,22 and 23 and cross defendant Adrian Gluck's interrogatories to The Upper Deck Company and The Upper Deck Company LLC Nos. 3,4,9,11 and 12, dated Nov. 16, 2004.

Cross defendant Adrian Gluck's second set of interrogatories to The Upper Deck Company and The Upper Deck Company LLC (Nos. 5–9), dated Jun. 29, 2004.

Defendant The Upper Deck Company's and The Upper Deck Company LLC's responses and objections to: 1. Plaintiff Media Technologies eighth set of interrogatories (Nos. 22–23) and 2. Cross Defendant Adrian Gluck's second set of interrogatories (5–9), dated Sep. 24, 2004.

Defendant The Upper Deck Company's & counter/cross claimants The Upper Deck Company LLC's first set of requests for admission for plaintiff Media Technologies Licensing, LLC, dated Oct. 1, 2004.

Plaintiff Media Technologies Licensing, LLC's response to defendant Upper Deck's first set of requests for admissions, dated Nov. 1, 2004.

Playoff's first set of requests for admissions to Media Tech (Nos. 1–183), dated Oct. 2, 2004.

Plaintiff Media Technologies Licensing, LLC's response to Defendant Playoff's first set of requests for admissions, dated Nov. 3, 2004.

CET's first set of interrogatories (Nos. 1–3), dated Sep. 29, 2003.

Plaintiff's response to CET's first set of interrogatories (Nos. 1–3), dated Nov. 3, 2003.

Defendant Fleer/Skybox International LP's first set of interrogatories to plaintiff, dated Sep. 29, 2003.

Plaintiff's response to Fleer/Skybox International's first set of interrogatories (Nos. 1–3), dated Nov. 3, 2003.

Defendant Fleer/Skybox International LP's second set of interrogatories to plaintiff, dated Oct. 3, 2003.

Plaintiff's response to Fleer/Skybox International's second set of interrogatories (No. 4), dated Nov. 6, 2003.

In The Game's first set of interrogatories (Nos. 1–3), dated Sep. 29, 2003.

Plaintiff's response to In The Game's first set of interrogatories (Nos. 1–3), dated Nov. 3, 2003.

Inkwork's first set of interrogatories (Nos. 1–10), dated Sep. 29, 2003.

Plaintiff's response to Inkwork's first set of interrogatories (Nos. 1–10), dated Nov. 3, 2003.

Pacific's first set of interrogatories (Nos. 1–3), dated Sep. 29, 2003.

Plaintiff's response to Pacific's first set of interrogatories (Nos. 1–3), dated Nov. 3, 2003.

Playoff's first set of interrogatories (Nos. 1–3), dated Sep. 29, 2003.

Plaintiff's response to Playoff's first set of interrogatories (Nos. 1–3), dated Nov. 3, 2003.

Playoff's second set of interrogatories (Nos. 4–15), dated Oct. 2, 2004.

Plaintiff Media Technologies Licensing LLC's response to defendants Playoff's second set of interrogatories (Nos. 4–15), dated Nov. 3, 2004.

Defendant Racing Champions Corporation and Racing Champion South, Inc.'s first set of interrogatories to plaintiff Media Technologies Licensing, LLC (Nos. 1–9), dated Sep. 29, 2003.

Plaintiff's response to Racing Champions Corporation and Racing Champion South, Inc.'s first set of interrogatories to plaintiff Media Technologies Licensing, LLC ( Nos. 1–9), dated Nov. 3, 2003.

Rittenhouse's first set of interrogatories (Nos. 1–3), dated Sep. 29, 2003.

Plaintiff Media Technologies Licensing, LLC's response to Rittenhouse's first set of interrogatories (Nos. 1–3); dated Nov. 2, 2003.

Defendant The Topps Company, Inc's first set of interrogatories addressed to plaintiff, dated Sep. 29, 2003.

Plaintiff's response to The Topps Company, Inc's first set of interrogatories (Nos. 1–4), dated Nov. 3, 2003.

Defendants The Upper Deck Company's and The Upper Deck Company LLC's first set of Interrogatories to Media Technologies Licensing, LLC, dated Sep. 29, 2003.

Plaintiff's response to The Upper Deck Company LLC's first set of interrogatories (Nos. 1–9), dated Nov. 3, 2003.

Plaintiff Media Technologies Licensing LLC's Supplemental response to defendant The Upper Deck, LLC's first set of interrogatories (Nos. 1–9), dated Nov. 8, 2003.

Defendants The Upper Deck Company's and The Upper Deck Company LLC's second set of interrogatories to Media Technologies Licensing LLC, dated Jun. 3, 2004.

Plaintiff Media Technologies Licensing LLC's response to The Upper Deck Company's and The Upper Deck Company LLC's second set of interrogatories (Nos. 10–19), dated Aug. 16, 2004.

Plaintiff Media Technologies Licensing LLC's first supplemental response to defendants The Upper Deck Company and The Upper Deck Company LLC's second set of interrogatories (Nos. 10–19), dated Nov. 8, 2004.

Defendant The Upper Deck Company and The Upper Deck Company LLC's third set of interrogatories to Media Technologies Licensing LLC, dated Oct. 1, 2004.

Plaintiff Media Technologies Licensing LLC's response to The Upper Deck Company and The Upper Deck Company LLC's third set of interrogatories (Nos. 20–25), dated Nov. 1, 2004.

Defendants Motion in Limine No. 2; Memorandum of Point of Authorities in support of Defendants The Upper Deck Company, The Upper Deck Company, LLC, Playoff Corp., and Inkwork's, Inc.'s motion in limine to preclude evidence and argument regarding claims 4 and 15 of the '532 patent on the ground that they are invalid due to double patenting; dated Dec. 22, 2004.

Declaration of Natalie J. Morgan in support of Defendants The Upper Deck Company, The Upper Deck Company, LLC, Playoff Corp., and Inkworks, Inc's motion in limine to preclude evidence and argument regarding claims 4 and 15 of the '532 patent on the ground that they are invalid due to double patenting, dated Dec. 22, 2004.

Plaintiff Media Technologies' memorandum of points and authorities in opposition to defendants motion in limine No. 2 to preclude evidence and argument regarding claims 4 and 15 of the '532 patent on double patenting grounds; Declaration of Sean Luner, dated May 16, 2005.

Defendants' reply to their motion in limine No. 2 to preclude evidence and argument regarding claims 4 and 15 of the '532 patent on the ground that they are invalid due to double patenting, dated Jul. 19, 2005.

Memorandum of points and authorities in support of defendants' summary judgment motion that the patents–in–suit are invalid under 35 U.S.C. § 102, dated Mar. 15, 2004.

Statement of uncontroverted facts and conclusions of law in support of Defendants' motion for summary judgment that the patents–in suit are invalid under 35 U.S.C. § 102, dated Mar. 15, 2004.

Declaration of Brent Devett in support of Defendants' motion for summary judgment of that the patents–in–suit are invalid under 35 U.S.C. § 102, dated Mar. 15, 2004.

Declaration of Lawrence C. Einhorn in support of Defendants' motion for summary judgment of that the patents–in–suit are invalid under 35 U.S.C. § 102, dated Mar. 15, 2004.

Declaration of Roxanne Toser in support of Defendants' motion for summary judgment of that the patents–in–suit are invalid under 35 U.S.C. § 102, dated Mar. 15, 2004.

Declaration of Jeff Augsburger in support of Defendants' motion for summary judgment of that the patents–in–suit are invalid under 35 U.S.C. § 102, dated Mar. 15, 2004.

Declaration of Howard Royle in support of Defendants' motion for summary judgment of that the patents–in–suit are invalid under 35 U.S.C. § 102, dated Mar. 15, 2004.

Declaration of Kenneth L. Havekotte in support of Defendants' motion for summary judgment of that the patents–in–suit are invalid under 35 U.S.C. § 102, dated Mar. 15, 2004.

Declaration of David G. Hanson in support of Defendants' motion for summary judgment of that the patents–in–suit are invalid under 35 U.S.C. § 102, dated Mar. 15, 2004.

Declaration of Cy Stapleton in support of Defendants' motion for summary judgment of that the patents–in–suit are invalid under 35 U.S.C. § 102, dated Mar. 15, 2004.

Declaration of F.T. Alexandra Mahaney in support of Defendants' motion for summary judgment of that the patents–in–suit are invalid under 35 U.S.C. § 102, dated Mar. 15, 2004.

Declaration of Daniel S. Berlin in support of Defendants' motion for summary judgment of that the patents–in–suit are invalid under 35 U.S.C. § 102, dated Mar. 15, 2004.

Opposition to Defendants' motion for summary judgment on invalidity, dated May 10, 2004.

Plaintiff Media Technologies' response to statement of uncontroverted facts and conclusions of law in support of defendants' motion for summary judgment that the patents–in–suit are invalid under 35 U.S.C. § 102, dated May 10, 2004.

Declaration of Sean Luner in support of Media Technologies' oppositions to (1) Topps' motion that its Michael Finley trading card does not infringe the '501 patent; and (2) Defendants' motion that the patents are invalid for anticipation; Declaration under 56 (f), dated May 10, 2004.

Declaration of Adrian Gluck in support of Media Technologies' oppositions to (1) Topps' motion that its Michael Finley trading card does not infringe the '501 patent; and (2) Defendants' motion that the patents are invalid for anticipation; Declaration under 56 (f), dated May 10, 2004.

Objections to defendants' and Topps' evidence in connection with (1) Defendants' motion for summary judgment on invalidity; and (2) Topps' motion for summary judgment on infringement, dated May 10, 2004.
Amended objections to Defendants' and Topps' evidence in connection with Defendants' motion for summary judgment on invalidity with respect to the Declaration of Daniel Berlin, dated May 14, 2004.
Declaration of Robert Pressman in support if Media Technologies' Oppositions to Defendants' motion that the patents are invalid for anticipation, dated May 14, 2004.
Defendants' reply brief in support of their summary judgment motion that the patents–in–suit are invalid under 35 U.S.C. § 102, dated May 17, 2004.
Defendants' reply to objections to defendants' evidence in connection with defendants' motion for summary judgment on invalidity, dated May 17, 2004.
Declaration of Steven J. Rocci in support of Defendants' reply in support of their Defendants' motion for summary judgment on invalidity, dated May 17, 2004.
Declaration of F.T. Alexandra Mahaney in support of Defendants' reply in support of their Defendants' motion for summary judgment on invalidity, dated May 17, 2004.
Declaration of Alison R. Ladd in support of Defendants' reply bried in support of their summary judgment motion that the patents–in–suit are invalid under 35 U.S.C. § 102, dated May 17, 2004.
Supplemental declaration of Jeff Augsberger in support of Defendants' reply in support of their Defendants' motion for summary judgment on invalidity, dated May 17, 2004.
Defendants' corrected reply brief in support of their summary judgment motion that the patents–in–suit are invalid under 35 U.S.C. § 102, dated Jun. 10, 2004.
Plaintiff Media Technologies' demonstrative exhibits re: 1. Plaintiff's opposition to Defendants' motion for summary judgment that the '501 and '532 patents are invalid; and 2. Plaintiff's opposition to Topps' motion for summary judgment adjudication of non–infringement of '501 patent, dated Jun. 22, 2004.
Defendants' application for an ex parte order allowing defendants to file late declaration of Dale E. Larsson in support of their motion for summary judgment that the patents–in–suit are invalid under 35 U.S.C. S 102 and memorandum in support thereof; declaration of Dale E. Larsson in support of their motion for summary judgment that the patents–in–suit are invalid under 35 U.S.C. § 102; Affidavit of Dale E. Larsson, dated Jul. 23, 2004.
[Proposed] order allowing Defendants to file late declaration of Dale E. Larsson in support of their motion for summary judgment that the patents–in–suit are invalid under 35 U.S.C. § 102 DENIED, dated Jul. 26, 2004.
Opposition to Defendant's application for an ex parte order allowing the defendants to file the Larsson Declaration, dated Jul. 26, 2004.
Civil Minutes—General; Order 1) Denying defendants' motion for summary judgment that the patents–in–suit ar invalid under 35 U.S.C. § 102 and 2) Denying The Topps Co., Inc's motion for summary judgment of non–infringement, dated Jul. 27, 2004.
Docket Report; Civil Docket For Case #: 8:03–cv–00897–AHS–AN; dated Apr. 11, 2006, 10 pages.
Docket Report; Civil Docket For Case #: 8:01–cv–01198–AHS–AN; dated Apr. 11, 2006; 59 pages.
Civil Docket; Case No: 3:05cv2193, 4 pages.
Case Sheet; Case No: GIN048601, 2 pages.
Complaint for Declaratory Relief, Demand for Jury Trial, Nov. 14, 2005.
Notice of Related Case Filed By Plaintiffs The Upper Deck Company and The Upper Deck Company, LLC, Dec. 1, 2005.
Plaintiffs' motion to remand civil action; Memorandum of points and authorities in support thereof; Declaration of Joanna M. Esty in support thereof, Dec. 23, 2005.
Opposition of Media Technologies Licensing, LLC and Adrian Gluck to Upper Deck's motion to remand; Memorandum of points and authorities; Declaration of Sean Luner. Jan. 9, 2006.
Plaintiff's reply in support of motion for remand; Jan. 20, 2006.
Notice of motion and joint motion by defendant Media Technologies Licensing, LLC and defendant Adrian Gluck to dismiss Upper Deck's Complaint pursuant to Federal Rules of Civil procedure, Rule 12(b)(6); Memorandum of points and authorities; Dec. 5, 2005.
Plaintiff's opposition to Defendants' motion to dismiss complaint pursuant to Federal Rules of Civil Procedure 12(b)(6), Jan. 27, 2006.
Reply: Defendant Media Technologies Licensing, LLC's and Defendant Adrian Gluck's motion to dismiss Upper Deck's Complaint pursuant to Federal Rules of Civil Procedure, Rule 12(b)(6), Feb. 10, 2006.
Request for Ex Parte Reexamination In Re United States Patent No. 5,417,431, issued May 23, 1996. Title: Trading Card With Three–Dimensional Effect.
Request for Ex Parte Reexamination In Re United States Patent No. 5,421,583, issued Jun. 6, 1995. Title: Print Media Product with Enhanced Realism.
Request for Ex Parte Reexamination In Re United States Patent No. 5,803,501, issued Sep. 8, 1988. Title: Memorabilia Card.
Request for Ex Parte Reexamination In Re United States Patent No. 6,142,532, issued Nov. 7, 2000. Title: Memorabilia Card.
Fleer 1990 Baseball Collectors Pin.
Fleer 1990 Basketball Collectors Pin.
Fleer 1990 Basketball Collectors Pin.
1990 Jim Abbot MVP Major League Collector Pin.
1990 Mark McGwire MVP Major League Collector Pin.
1990 Ryne Sandberg MVP Major League Collector Pin.
1991 Andre Dawson MVP Major League Collector Pin.
1991 Carlton Fisk Major League Collector Pin.
1991 Mark Grace Major League Collector Pin.
1974 Los Angeles Dodgers Reggie Jackson Card.
Matt Williams Star Career Stats Card.
1987 Fleer Limited Edition Steve Garvey Card.
The Pre 1070 Sports Card Lingo and Guides.
Exhibit 3—Marilyn Monroe Diamond Card, Sports Time Card Company, Inc., 1993.
Exhibit 4—Beatles: Original Whittier Hotel, Einhorn–Victor Productions, 1964.
Exhibit 5—Beatles: Riviera Hotel, 1984.
Exhibit 6—Beatles: Fake Riviera Hotel, Circa 1970.
Exhibit 7—James Dean's Jeans Card, Maiden Jest, Inc., 1983.
Exhibit 8—Father Stephen Eckert Card, St. Benedict The Moor Mission, 1927.

Exhibit 9—Skylab Parasol Card, NASA, Circa 1973—Appollo–Soyuz Kapton Foil Card, Ken Havekotte, Circa 1980—Appollo 14 Safety–Line Card, NASA, Circa 1972.

Exhibit 10—Marilyn Monroe Card Advertisement, Non–Sport Update, Oct.–Dec. 1993.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4, 12, 13 and 15 are determined to be patentable as amended.

Claims 3, 5–11 and 14, dependent on an amended claim, are determined to be patentable.

New claims 16–29 are added and determined to be patentable.

1. An article of memorabilia comprising[.]*;* a first member, *the first member being a sports trading card having a face surface,* and a portion, but not the entirety, of an authentic memorabilia item used by a popular sport [or entertainment] personality [or during a memorable event], said portion attached to said first member.

2. An article as in claim 1 wherein [the first member is a card having a face surface, and] said portion is attached to said face surface.

4. An article as in claim 1 wherein [the first member includes a sports trading card having an image surface, and] said portion is affixed to said *face* surface near where an image of the authentic item normally would appear.

12. An article of memorabilia comprising, a first member, *the first member being a trading card having a face surface,* and a portion, but not the entirety, of an authentic memorabilia item used in a popular sport or form of entertainment or during a memorable event, said portion incorporated into said first member.

13. A memorabilia article comprising *a trading card having an image surface and* at least a piece of an authentic implement used or worn either by a popular sport or entertainment person or during a memorable event and wherein less than all of the implement is [included] *attached to the trading card.*

15. An article as in claim 13 [further including a card having an image surface, and the article being], *wherein the implement is* adhered to said *image* surface near where an image of the implement normally would appear.

*16. A memorabilia card comprising:*

*a sports trading card, said sports trading card containing an image surface, said image surface depicting an image of at least a portion of an athlete;*

*a piece of an authentic memorabilia item used or worn by the athlete, wherein less than all of the memorabilia item is included;*

*the piece of the authentic memorabilia item being attached to the sports trading card such that the image of the athlete and the piece of the authentic memorabilia item are both visible when looking at the image of the athlete.*

*17. A memorabilia card as in claim 16, wherein the authentic memorabilia item is clothing worn by the athlete.*

*18. An article of memorabilia comprising:*

*a sports trading card comprising an image of an athlete on a first side and information relating to the athlete on a second side, and*

*a portion, but not the entirety, of an authentic memorabilia item used by the athlete, said portion attached to the sports trading card.*

*19. An article as in claim 16, wherein the memorabilia item comprises an article of clothing.*

*20. An article as in claim 16, wherein the article of clothing comprises a jersey.*

*21. An article as in claim 16, wherein the authentic memorabilia item is a baseball bat, and said portion comprises a piece of wood taken from that bat.*

*22. A memorabilia card comprising:*

*an entertainment trading card, said entertainment trading card containing an image surface, said image surface depicting an image of at least a portion of an entertainer;*

*a piece of an authentic memorabilia item used or worn by the entertainer, wherein less than all of the memorabilia item is included;*

*the piece of the authentic memorabilia item being attached to the entertainment trading card such that the image of the entertainer and the piece of the authentic memorabilia item are both visible when looking at the image of the entertainer.*

*23. An article of memorabilia comprising:*

*a first member, and*

*a portion, but not the entirety, of an authentic memorabilia item used by a popular sport or entertainment personality or during a memorable event, said portion attached to said first member wherein the authentic item is a baseball bat, and said portion comprises a tiny piece of wood taken from that bat.*

*24. An article of memorabilia comprising:*

*a first member, and*

*a portion, but not the entirety, of an authentic memorabilia item used by a popular sport or entertainment personality or during a memorable event, said portion attached to said first member wherein said portion comprises a tiny piece of an authentic item of clothing worn by the sports or entertainment personality.*

*25. An article of memorabilia comprising:*

*a first member, and*

*a portion, but not the entirety, of an authentic memorabilia item used by a popular sport or entertainment personality or during a memorable event, said portion attached to said first member wherein the authentic item is a baseball, and said portion comprises a tiny piece or material taken from said baseball.*

*26. An article of memorabilia comprising:*

*a first member, and*

*a portion, but not the entirety, of an authentic memorabilia item used by popular sport or entertainment personality or during a memorable event, said portion attached to said first member wherein the authentic item is a football, and said portion comprises a tiny piece of material taken from said football.*

*27. An article of memorabilia comprising:*

*a first member, and*

*a portion, but not the entirety, of an authentic memorabilia item used by a popular sport or entertainment personality or during a memorable event, said portion attached to said first member wherein the authentic item is a basketball, and said portion comprises a tiny piece of material taken from said basketball.*

*28. An article of memorabilia comprising:*

*a first member, and*

*a portion, but not the entirety, of an authentic memorabilia item used by a popular sport or entertainment personality or during a memorable event, said portion attached to said first member wherein the authentic item is a hockey puck, and said portion comprises a tiny piece of material taken from said hockey puck.*

*29. An article of memorabilia comprising:*

*a first member, and*

*a portion, but not the entirety, of an authentic memorabilia item used by a popular sport or entertainment personality or during a memorable event, said portion attached to said first member wherein the authentic item is a soccer ball, and said portion comprises a tiny piece of material taken from said soccer ball.*

* * * * *